US007753764B2

(12) United States Patent
Li

(10) Patent No.: US 7,753,764 B2
(45) Date of Patent: Jul. 13, 2010

(54) COIN COUNTER THAT GUIDES AND DELIVERS COINS SMOOTHLY TO PREVENT THE COINS FROM BEING CHOKED

(76) Inventor: Chiu-Fang Li, 45, Kai-an 3rd St., Annan District, Tainan (TW)

( * ) Notice: Subject to any disclaimer, the term of this patent is extended or adjusted under 35 U.S.C. 154(b) by 0 days.

(21) Appl. No.: 12/192,392

(22) Filed: Aug. 15, 2008

(65) Prior Publication Data

US 2010/0041326 A1 Feb. 18, 2010

(51) Int. Cl.
*G07D 9/00* (2006.01)
*G07D 9/04* (2006.01)

(52) U.S. Cl. ..... 453/58

(58) Field of Classification Search ..... 453/58
See application file for complete search history.

(56) References Cited

U.S. PATENT DOCUMENTS 3,902,511 A * 9/1975 Jacobs ..... 453/32
4,752,274 A * 6/1988 Abe ..... 453/32
5,607,352 A * 3/1997 Tani ..... 453/57
7,182,299 B2 * 2/2007 Takeuchi ..... 248/71
7,301,759 B2 * 11/2007 Hsiung ..... 361/679.27
2005/0227604 A1 * 10/2005 Chang ..... 453/18
2007/0066202 A1 * 3/2007 Hu et al. ..... 453/18

* cited by examiner

*Primary Examiner*—Patrick Mackey
*Assistant Examiner*—Mark Beachaine
(74) *Attorney, Agent, or Firm*—Alan Kamrath; Kamrath & Associates PA

(57) ABSTRACT

A coin counter includes a support bracket, a limit plate secured on the support bracket, a slide rod slidably mounted on the support bracket, a coin outlet port located between the limit plate and the slide rod, and a rotation disk rotatably mounted on the support bracket and having a plurality of receiving grooves to receive a plurality of coins. Thus, each of the coins directly passes between the limit plate and the slide rod into the coin outlet port, so that each of the coins is introduced into the coin outlet port smoothly to prevent the coins from being choked at the coin outlet port. In addition, the limit plate is provided with an adjusting slot to change and adjust the distance between the limit plate and the slide rod to allow passage of coins of different sizes.

17 Claims, 8 Drawing Sheets

COIN COUNTER THAT GUIDES AND DELIVERS COINS SMOOTHLY TO PREVENT THE COINS FROM BEING CHOKED

BACKGROUND OF THE INVENTION

1. Field of the Invention

The present invention relates to a coin counter and, more particularly, to a coin counter having a coin output structure.

2. Description of the Related Art

A conventional coin counter in accordance with the prior art shown in FIG. 10 comprises a support bracket 60, a coin outlet port (not shown) mounted on and connected to the support bracket 60, a rotation disk 61 rotatably mounted on the support bracket 60 and having a peripheral wall provided with a plurality of receiving grooves (not shown) to receive a plurality of coins 65 wherein each of the receiving grooves of the rotation disk 61 is movable to approach the coin outlet port to introduce each of the coins 65 into the coin outlet port, a stop bar 63 mounted on the support bracket 60 and located above the coin outlet port to stop movement of the coins 65 so that only one of the coins 65 is allowed to enter the coin outlet port, a rotation shaft 62 rotatably mounted on the support bracket 60 and secured on the rotation disk 61 to rotate the rotation disk 61, a drive motor 64 mounted on the support bracket 60 and connected to the rotation shaft 62 to rotate the rotation shaft 62, and a cover 66 mounted on the support bracket 60 to cover the rotation disk 61. In operation, when the rotation disk 61 is rotated, each of the coins 65 is driven by the respective receiving groove of the rotation disk 61 to pass through the stop bar 63 into the coin outlet port and is delivered outwardly from the coin outlet port. However, the rotation disk 61 is rotated at a high speed so that more than two coins 65 are easily inserted into the stop bar 63 at the same time to choke the coin outlet port, thereby affecting operation of the coin counter.

BRIEF SUMMARY OF THE INVENTION

In accordance with the present invention, there is provided a coin counter, comprising a support bracket, a limit plate adjustably secured on the support bracket, a slide rod slidably mounted on the support bracket, a coin outlet port mounted on the support bracket and located between the limit plate and the slide rod, and a rotation disk rotatably mounted on the support bracket and having a peripheral wall provided with a plurality of receiving grooves to receive a plurality of coins wherein each of the receiving grooves of the rotation disk is movable to a position between the limit plate and the slide rod to insert each of the coins between the limit plate and the slide rod into the coin outlet port.

The primary objective of the present invention is to provide a coin counter that guides and delivers coins smoothly to prevent the coins from being choked.

Another objective of the present invention is to provide a coin counter, wherein each of the coins directly passes between the limit plate and the slide rod into the coin outlet port, so that each of the coins is compressed and introduced into the coin outlet port easily and smoothly to prevent each of the coins from being choked at the coin outlet port.

A further objective of the present invention is to provide a coin counter, wherein each of the coins directly passes between the limit plate and the slide rod into the coin outlet port, so that the coin counter needs not to provide a stop bar to stop movement of the coins, thereby decreasing the costs of fabrication.

A further objective of the present invention is to provide a coin counter, wherein the limit plate is provided with an adjusting slot to change and adjust a distance between the limit plate and the slide rod to allow passage of the coins of different sizes.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
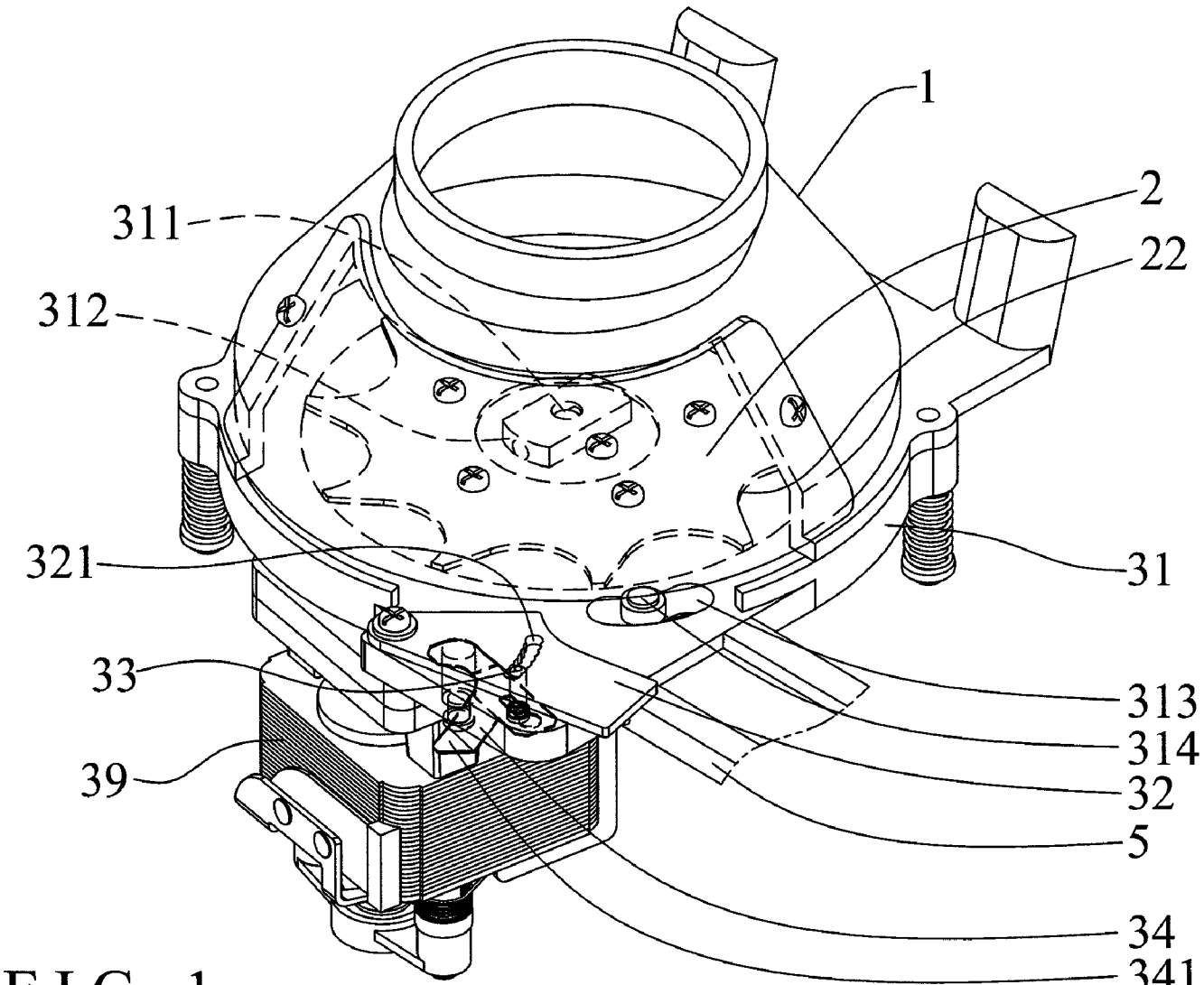
FIG. 1 is a perspective view of a coin counter in accordance with the preferred embodiment of the present invention.

Referring to the drawings and initially to FIGS. 1-7, a coin counter in accordance with the preferred embodiment of the present invention comprises a support bracket 31, a limit plate 32 adjustably secured on the support bracket 31, a slide rod 314 slidably mounted on the support bracket 31, a coin outlet port 5 mounted on the support bracket 31 and located between the limit plate 32 and the slide rod 314, a rotation disk 2 rotatably mounted on the support bracket 31 and having a peripheral wall provided with a plurality of receiving grooves 22 to receive a plurality of coins 4 wherein each of the receiving grooves 22 of the rotation disk 2 is movable to a position between the limit plate 32 and the slide rod 314 to insert each of the coins 4 between the limit plate 32 and the slide rod 314 into the coin outlet port 5, a drive block 312 rotatably mounted on the support bracket 31 and secured in a central portion of the rotation disk 2 to rotate the rotation disk 2, a rotation shaft 311 rotatably mounted on the support bracket 31 and secured in the drive block 312 to rotate the drive block 312, a drive motor 39 mounted on the support bracket 31 and connected to the rotation shaft 311 to rotate the rotation shaft 311, and a cover 1 mounted on the support bracket 31 to cover the rotation disk 2.

The support bracket 31 has a periphery provided with a substantially arc-shaped guide slot 313, and the slide rod 314 is slidable in the guide slot 313 of the support bracket 31. The support bracket 31 has a side provided with a through hole 310. The limit plate 32 has a mediate portion provided with a substantially arc-shaped adjusting slot 321. The adjusting slot 321 of the limit plate 32 has two opposite sides each provided with a plurality of corrugated positioning recesses 322. The limit plate 32 has a first end 320 pivotally mounted on the support bracket 31 and a second end 323 protruding outwardly from the support bracket 31. The adjusting slot 321 of the limit plate 32 is located between the first end 320 and the second end 323 of the limit plate 32.

The coin counter further comprises a support shaft 38 secured on the support bracket 31, a drive plate 37 pivotally mounted on the support shaft 38 and having an end portion connected to the slide rod 314 to drive the slide rod 314 to move relative to the support bracket 31, a fixing rod 35 secured on the support bracket 31, and an elastic member 36 biased between the fixing rod 35 and the end portion of the drive plate 37 to drive the drive plate 37 to pivot relative to the support shaft 38 and to drive the slide rod 314 toward the limit plate 32. The fixing rod 35 is located under the limit plate 32. The end portion of the drive plate 37 is provided with a fixing hole 371. The elastic member 36 has a first end secured to a lower end of the fixing rod 35 and a second end secured in the fixing hole 371 of the drive plate 37.

The coin counter further comprises an adjusting rod 33 movably mounted on the support bracket 31 and detachably mounted in the adjusting slot 321 of the limit plate 32, and an elastic plate 34 having a first end mounted on the fixing rod 35 and a second end mounted on the adjusting rod 33 to move the adjusting rod 33 relative to the support bracket 31. The adjusting rod 33 is movably mounted in the through hole 310 of the support bracket 31 and is detachably positioned in one of the positioning recesses 322 of the adjusting slot 321 of the limit plate 32. The adjusting rod 33 has an upper end detachably mounted in the adjusting slot 321 of the limit plate 32 and a lower end attached to the second end of the elastic plate 34. Thus, the adjusting rod 33 is movable relative to the support bracket 31 between a first position where the adjusting rod 33 is inserted into the adjusting slot 321 of the limit plate 32 so that the limit plate 32 is fixed on the support bracket 31 and a second position where the adjusting rod 33 is detached from the adjusting slot 321 of the limit plate 32 to unlock the limit plate 32 from the adjusting rod 33 so that the limit plate 32 is pivotable on the support bracket 31. The elastic plate 34 abuts a bottom of the support bracket 31 and has a side provided with a protruding press portion 341 to press the elastic plate 34 downward relative to the limit plate 32 and to detach the adjusting rod 33 from the adjusting slot 321 of the limit plate 32.

Figure 2:
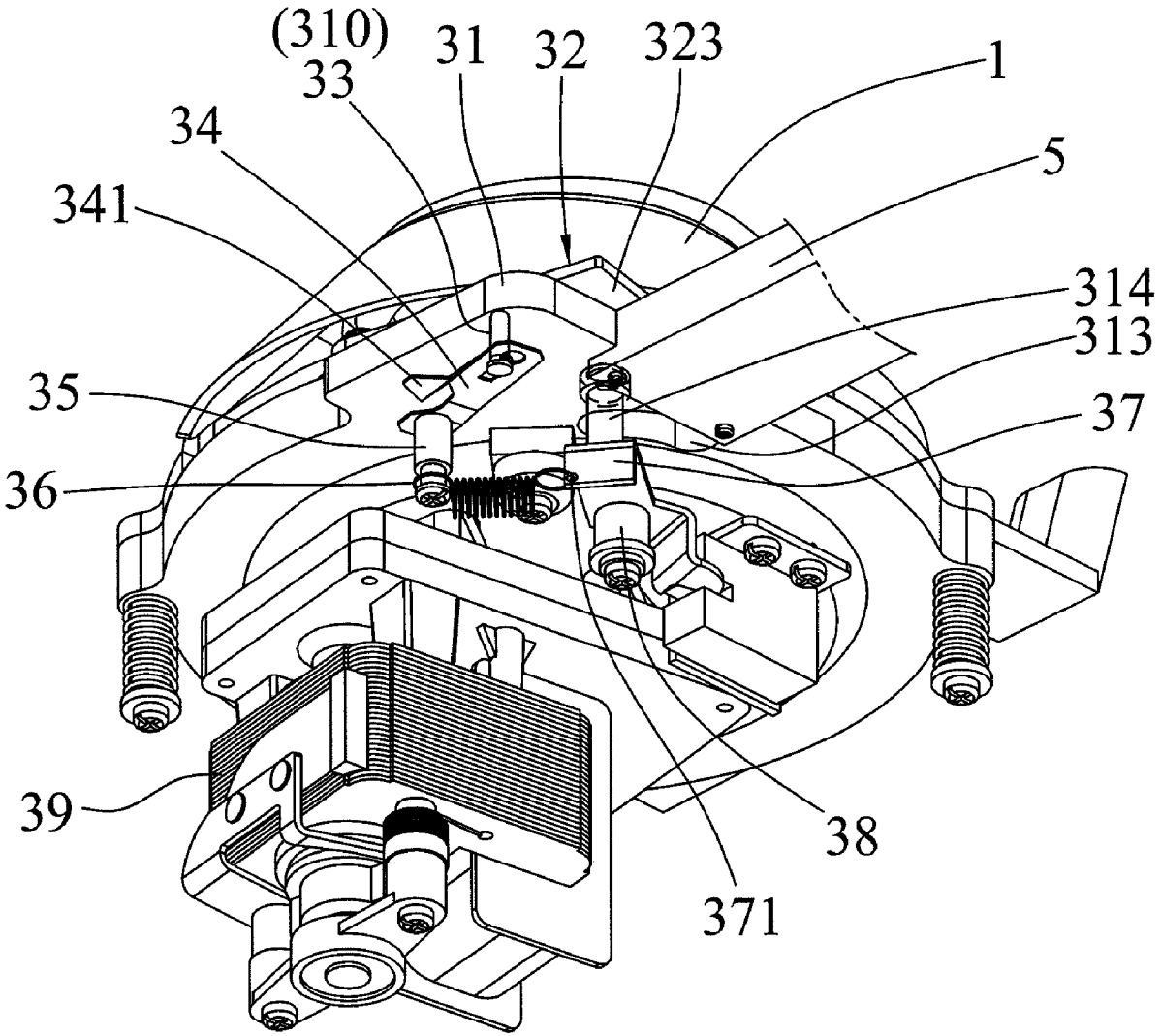
FIG. 2 is a bottom perspective view of the coin counter as shown in FIG. 1.
Figure 3:
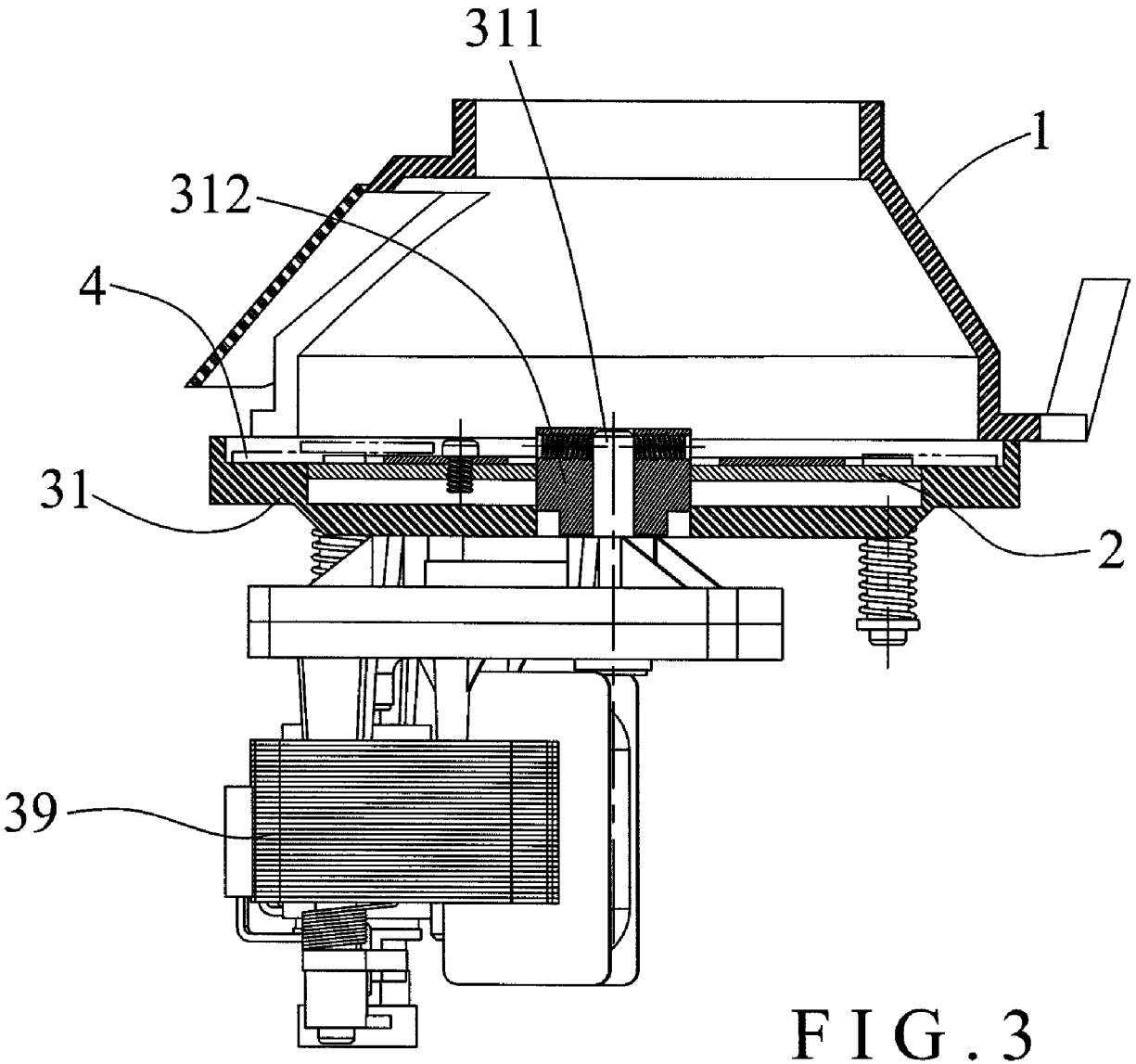
FIG. 3 is a front cross-sectional view of the coin counter as shown in FIG. 1.
Figure 4:
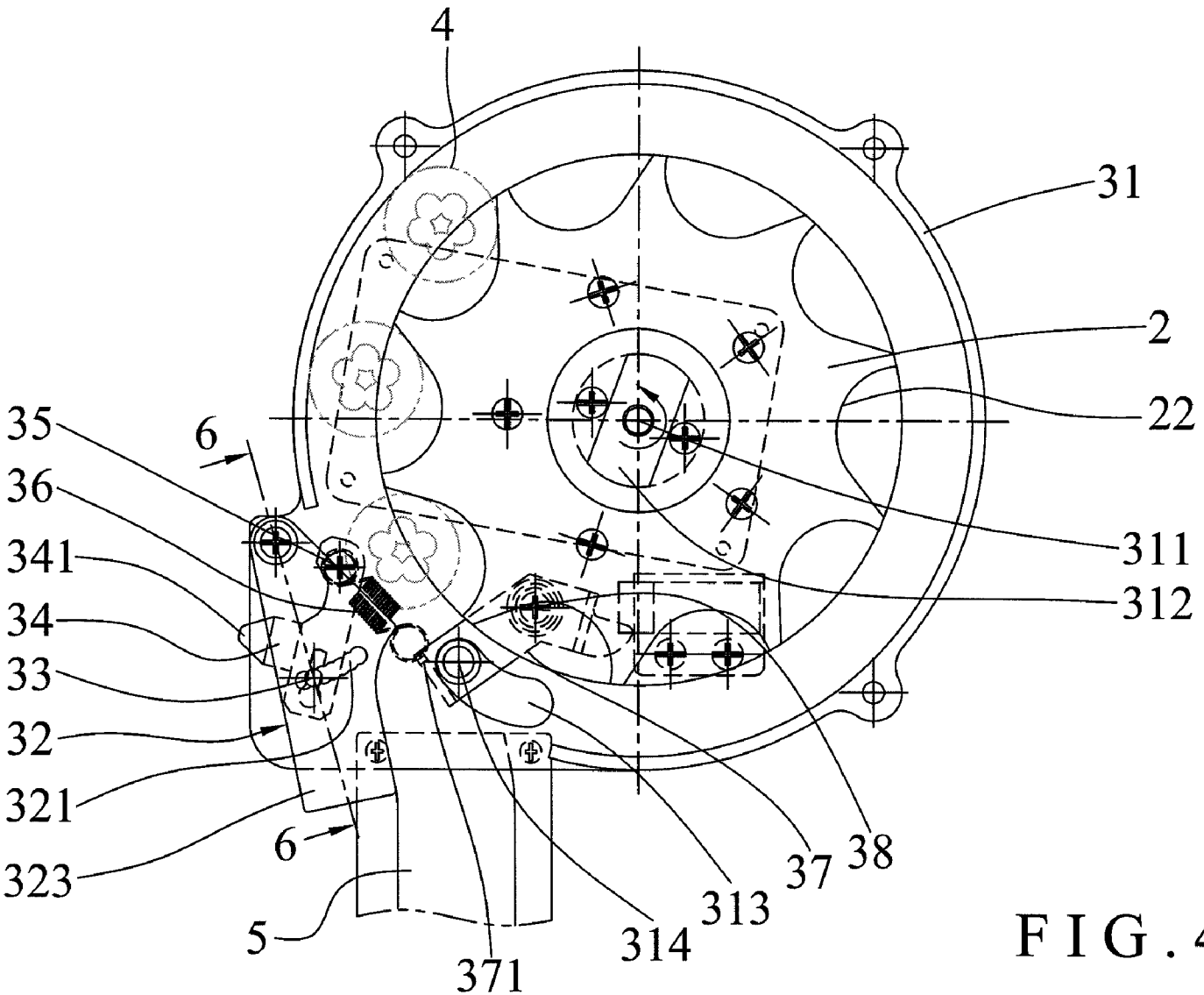
FIG. 4 is a front cross-sectional view of the coin counter as shown in FIG. 1.

In operation, referring to FIG. 4 with reference to FIGS. 1-3, the rotation shaft 311 is driven by the drive motor 39 to rotate the drive block 312 which rotates the rotation disk 2 which moves the receiving grooves 22 which drive the coins 4 to move on the support bracket 31 and to approach the limit plate 32 and the slide rod 314. In such a manner, when the rotation disk 2 is rotated counterclockwise as shown in FIG. 4, each of the coins 4 is driven by the respective receiving groove 22 of the rotation disk 2 to abut the limit plate 32 and the slide rod 314. At this time, the limit plate 32 is fixed on the support bracket 31, and the slide rod 314 is pushed by one of the coins 4 to move in the guide slot 313 of the support bracket 31 and to space from the limit plate 32, so that one of the coins 4 is compressed and allowed to pass between the limit plate 32 and the slide rod 314 into the coin outlet port 5 and is delivered outwardly from the coin outlet port 5. At the same time, when the slide rod 314 is moved in the guide slot 313 of the support bracket 31 to space from the limit plate 32, the drive plate 37 is moved with the slide rod 314 to extend the elastic member 36. Thus, after the force applied by one of the coins 4 on the slide rod 314 is removed, the slide rod 314 is pulled by the restoring force of the elastic member 36 to return to the original state.

Figure 6:
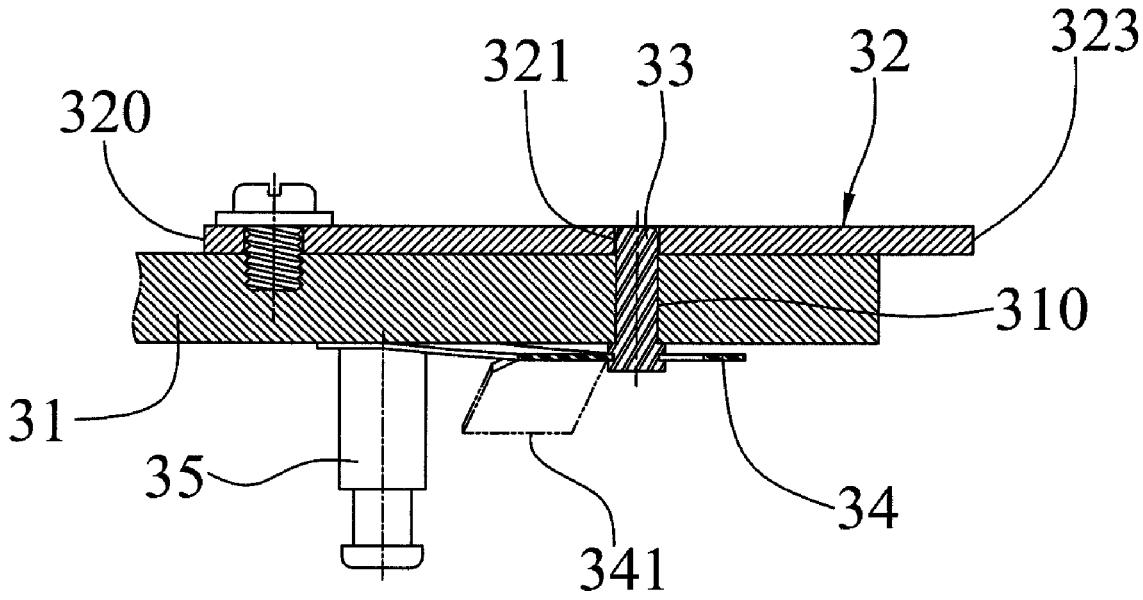
FIG. 6 is a side cross-sectional view of the coin counter as shown in FIG. 1.
Figure 7:
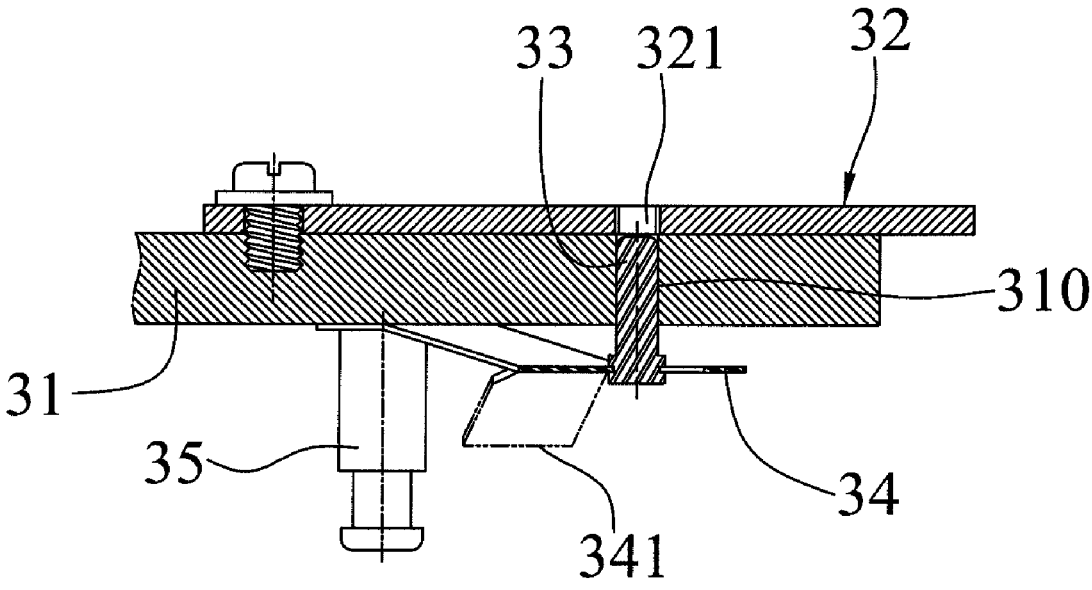
FIG. 7 is a schematic operational view of the coin counter as shown in FIG. 6.
Figure 8:
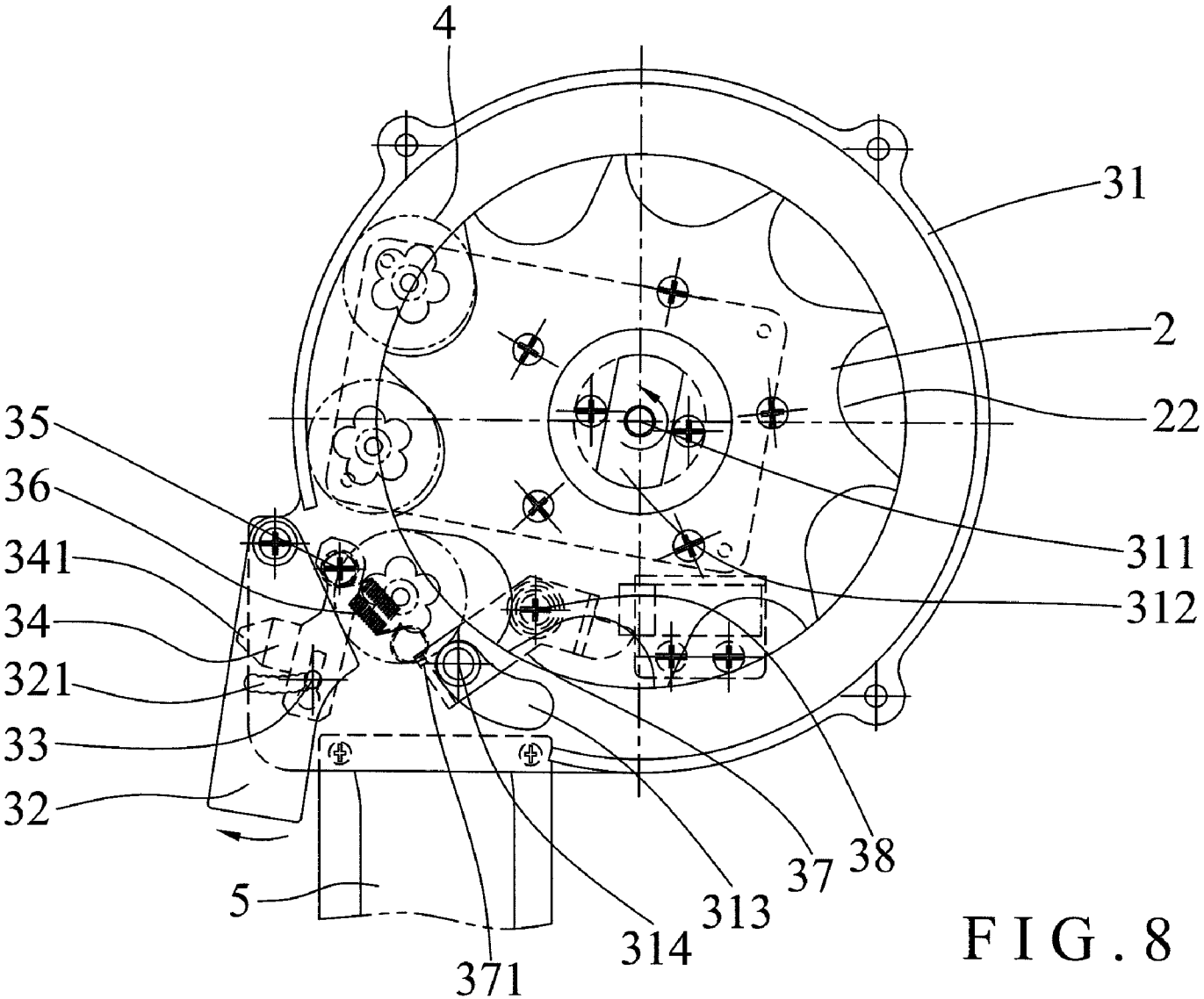
FIG. 8 is a schematic operational view of the coin counter as shown in FIG. 4.
Figure 10:
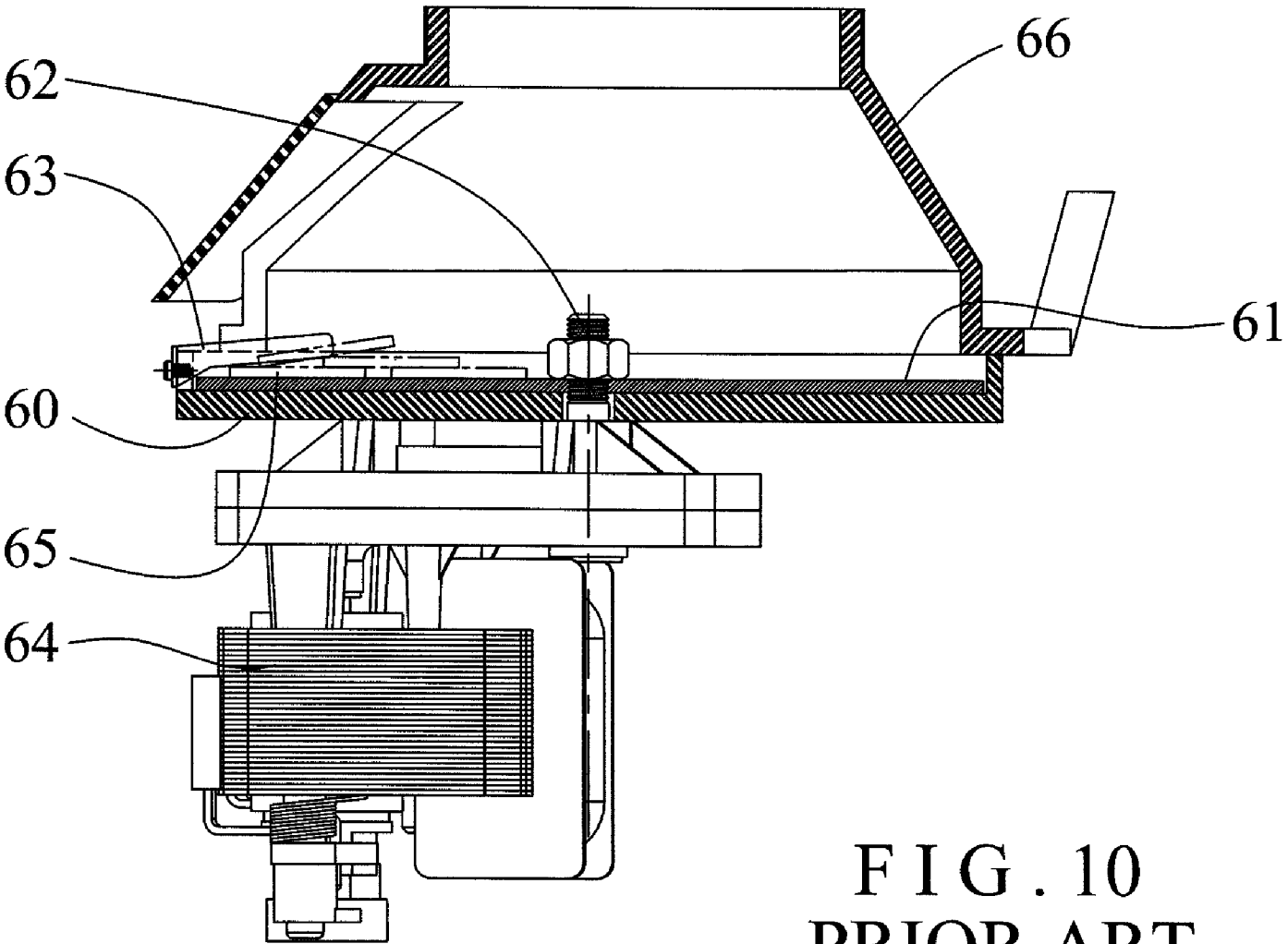
FIG. 10 PRIOR ART
FIG. 10 is a front cross-sectional view of a conventional coin counter in accordance with the prior art.

In adjustment, referring to FIGS. 6-8 with reference to FIGS. 1-5, when the press portion 341 of the elastic plate 34 is pressed downward by a user's finger, the elastic plate 34 is moved downward to detach the adjusting rod 33 from the adjusting slot 321 of the limit plate 32 as shown in FIG. 7 to unlock the limit plate 32 from the adjusting rod 33, so that the limit plate 32 is pivotable on the support bracket 31 to change and adjust a distance between the limit plate 32 and the slide rod 314 as shown in FIG. 8 to allow passage of the coins 4 of different sizes. After the force applied on the press portion 341 of the elastic plate 34 is removed, the elastic plate 34 is moved upward by its restoring force to insert the adjusting rod 33 into the adjusting slot 321 of the limit plate 32 as shown in FIG. 6 to lock the limit plate 32 by the adjusting rod 33, so that the limit plate 32 is fixed on the support bracket 31.

Figure 9:
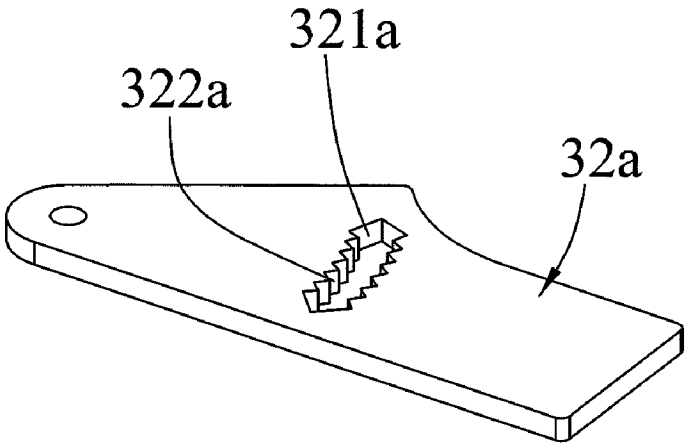
FIG. 9 is a perspective view of a limit plate of the coin counter in accordance with another preferred embodiment of the present invention.
Figure 5:
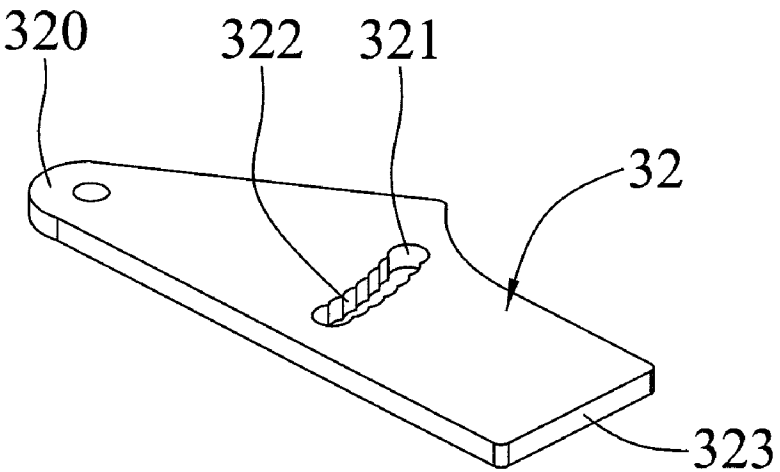
FIG. 5 is a perspective view of a limit plate of the coin counter as shown in FIG. 1.

As shown in FIG. 9, the adjusting slot 32 la of the limit plate 32*a* has two opposite sides each provided with a plurality of serrated positioning recesses 322*a*.

Accordingly, each of the coins 4 directly passes between the limit plate 32 and the slide rod 314 into the coin outlet port 5, so that each of the coins 4 is compressed and introduced into the coin outlet port 5 easily and smoothly to prevent each of the coins 4 from being choked at the coin outlet port 5. In addition, each of the coins 4 directly passes between the limit plate 32 and the slide rod 314 into the coin outlet port 5, so that the coin counter needs not to provide a stop bar to stop movement of the coins 4, thereby decreasing the costs of fabrication. Further, the limit plate 32 is provided with an adjusting slot 321 to change and adjust a distance between the limit plate 32 and the slide rod 314 to allow passage of the coins 4 of different sizes.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A coin counter, comprising:

a support bracket;

a limit plate adjustably secured on the support bracket;

a slide rod slidably mounted on the support bracket;

a coin outlet port mounted on the support bracket and located between the limit plate and the slide rod;

a rotation disk rotatably mounted on the support bracket and having a peripheral wall provided with a plurality of receiving grooves to receive a plurality of coins wherein each of the receiving grooves of the rotation disk is movable to a position between the limit plate and the slide rod to insert each of the coins between the limit plate and the slide rod into the coin outlet port;

wherein each of the receiving grooves of the rotation disk abuts a top of the support bracket;

each of the coins is supported and pushed by a respective one of the receiving grooves of the rotation disk to move relative to the support bracket;

the coin counter further comprises:

a support shaft secured on the support bracket;

a drive plate pivotally mounted on the support shaft and having an end portion connected to the slide rod to drive the slide rod to move relative to the support bracket;

a fixing rod secured on and located under the support bracket;

an elastic member biased between the fixing rod and the end portion of the drive plate to drive the drive plate to pivot relative to the support shaft and to drive the slide rod toward the limit plate;

wherein the limit plate has a mediate portion provided with a substantially arc-shaped elongate adjusting slot extending toward the slide rod;

the coin counter further comprises:

an adjusting rod movably mounted on the support bracket and detachably inserted into the adjusting slot of the limit plate;

an elastic plate located under the support bracket and having a first end mounted on the fixing rod and a second end mounted on the adjusting rod to support the adjusting rod and to move the adjusting rod relative to the support bracket.

2. The coin counter in accordance with claim 1, further comprising:

a drive block rotatably mounted on the support bracket and secured in a central portion of the rotation disk to rotate the rotation disk;

a rotation shaft rotatably mounted on the support bracket and secured in the drive block to rotate the drive block;

a drive motor mounted on the support bracket and connected to the rotation shaft to rotate the rotation shaft.

3. The coin counter in accordance with claim 1, wherein the support bracket has a periphery provided with a substantially arc-shaped guide slot;

the slide rod is slidable in the guide slot of the support bracket.

4. The coin counter in accordance with claim 1, wherein the adjusting slot of the limit plate has two opposite sides each provided with a plurality of positioning recesses;

the adjusting rod is detachably positioned in one of the positioning recesses of the adjusting slot of the limit plate.

5. The coin counter in accordance with claim 4, wherein the support bracket has a side provided with a through hole;

the adjusting rod extends through and is movably mounted in the through hole of the support bracket.

6. The coin counter in accordance with claim 4, wherein the positioning recesses of the adjusting slot of the limit plate have a corrugated profile.

7. The coin counter in accordance with claim 4, wherein the positioning recesses of the adjusting slot of the limit plate have a serrated profile.

8. The coin counter in accordance with claim 1, wherein the elastic plate has a side provided with a protruding press portion to press and move the elastic plate downward relative to the limit plate and to detach the adjusting rod from the adjusting slot of the limit plate.

9. The coin counter in accordance with claim 1, wherein the end portion of the drive plate is provided with a fixing hole;

the elastic member has a first end secured to a lower end of the fixing rod and a second end secured in the fixing hole of the drive plate.

10. The coin counter in accordance with claim 1, wherein the limit plate has a first end pivotally mounted on the support bracket and a second end protruding outwardly from the support bracket and pivotable about the adjusting slot.

11. The coin counter in accordance with claim 10, wherein the adjusting slot of the limit plate is located at a middle position between the first end and the second end of the limit plate.

12. The coin counter in accordance with claim 1, wherein the adjusting rod extends through the support bracket and has an upper end detachably inserted into the adjusting slot of the limit plate and a lower end protruding outward from a bottom of the support bracket and attached to the second end of the elastic plate.

13. The coin counter in accordance with claim 1, wherein the adjusting rod is movable relative to the support bracket between a first position where the adjusting rod is inserted into the adjusting slot of the limit plate so that the limit plate is fixed on the support bracket and a second position where the adjusting rod is detached from the adjusting slot of the limit plate to unlock the limit plate from the adjusting rod so that the limit plate is pivotable on the support bracket.

14. The coin counter in accordance with claim 1, wherein the elastic plate abuts a bottom of the support bracket.

15. The coin counter in accordance with claim 1, wherein the fixing rod is located under the limit plate, and the support bracket is located between the limit plate and the fixing rod.

16. The coin counter in accordance with claim 1, wherein each of the receiving grooves of the rotation disk is connected and open to a space between the limit plate and the slide rod when each of the receiving grooves of the rotation disk is movable to the position between the limit plate and the slide rod.

17. The coin counter in accordance with claim 16, wherein each of the receiving grooves of the rotation disk is connected and open to the coin outlet port when each of the receiving grooves of the rotation disk is movable to the position between the limit plate and the slide rod.

* * * * *